US006938597B2

(12) United States Patent
Klein et al.

(10) Patent No.: US 6,938,597 B2
(45) Date of Patent: Sep. 6, 2005

(54) VARIABLE SPRING FORCE INTAKE VALVE ASSEMBLY

(76) Inventors: Jeffrey F. Klein, 8106 Tichenor Point Ct., Millersville, MD (US) 21108; Konstantin Mikhailov, 3637 Chadwick Ct., Pasadena, MD (US) 21122

( * ) Notice: Subject to any disclaimer, the term of this patent is extended or adjusted under 35 U.S.C. 154(b) by 0 days.

(21) Appl. No.: 10/449,754

(22) Filed: May 30, 2003

(65) Prior Publication Data

US 2003/0217725 A1 Nov. 27, 2003

Related U.S. Application Data

(63) Continuation-in-part of application No. 10/372,704, filed on Feb. 24, 2003.

(60) Provisional application No. 60/384,995, filed on May 31, 2002, and provisional application No. 60/359,611, filed on Feb. 25, 2002.

(51) Int. Cl.[7] ..... F01L 3/10

(52) U.S. Cl. ..... 123/90.65; 123/90.15; 123/90.16; 251/77; 251/250; 251/337; 137/522

(58) Field of Search ..... 123/90.12–90.18, 123/90.39–90.59, 90.65; 74/569, 25, 53–55; 137/522; 251/77, 250, 249.5, 337

(56) References Cited

U.S. PATENT DOCUMENTS 3,745,883 A * 7/1973 Ward et al. ..... 91/186
4,267,627 A * 5/1981 Douglas ..... 29/217
4,325,286 A * 4/1982 Lang ..... 91/373
4,545,402 A * 10/1985 Lyons ..... 137/495
5,370,153 A * 12/1994 Galle ..... 137/614.04
5,692,537 A * 12/1997 Arian et al. ..... 137/486
5,762,106 A * 6/1998 Smith, III ..... 137/614.04
5,778,875 A * 7/1998 Morgan et al. ..... 128/204.26

* cited by examiner

*Primary Examiner*—Thomas Denion
*Assistant Examiner*—Jaime Corrigan
(74) *Attorney, Agent, or Firm*—Law Offices of Royal W. Craig

(57) ABSTRACT

Disclosed herein is a variable spring force intake valve for use in two- or four-stroke internal combustion engines. The device comprises an intake valve body and a torsion spring attached to a gear and rod assembly. Manipulation, via manual or automated means, of the gear and rod assembly adjusts the tension/torsion force exerted by the torsion spring to preload the intake valve and/or to hold the intake valve in the closed position. Varying the tension/torsion force results in an ability to control the timing and the degree to which the ports of the intake valve are actually opened during the operating cycle of the piston, thereby providing a user with an opportunity to enhance the operation of a two- or four-stroke internal combustion engine.

10 Claims, 2 Drawing Sheets

VARIABLE SPRING FORCE INTAKE VALVE ASSEMBLY

CROSS-REFERENCE TO RELATED APPLICATIONS

The present application derives priority from U.S. Provisional Patent Application No. 60/384,995; filed: May 31, 2002, and is a continuation-in-part of U.S. Utility patent application Ser. No. 10/372,704, filed on Feb. 24, 2003 (which derives priority from U.S. Provisional Application Ser. No. 60/359,611 for "SELF-CLEANING INTERNAL COMBUSTION ENGINE INTAKE VALVE" filed on Feb. 25, 2002).

BACKGROUND OF THE INVENTION

1. Field of the Invention

The present invention relates to internal combustion engines and, more particularly, to the intake valve structure for internal combustion engines, and even more particularly, to a means for controlling the timing and stroke of the intake valves of internal combustion engines.

2. Description of the Background

In a typical two-stroke internal combustion engine, power generation, as well as the exhaust and intake of the associated combustion products, takes place during the power, or down stroke. This is followed by additional exhaust and compression during the return, or up stroke. In operation, the ignition of the fuel/air mixture causes the pressure in the cylinder to rise and drives the piston downward through the cylinder. While traveling downward through the cylinder, the piston opens an exhaust port to expose the contents of the cylinder (which are under high pressure) to near atmospheric pressure. Those contents, or combustion products, held within the cylinder force themselves out of the cylinder through the open exhaust port. The piston continues its downward travel through the cylinder resulting in the opening of an intake port prior to the piston reaching its bottom dead center position. Generally, as the return stroke begins, the intake port closes. An ability to control the timing and stroke of the intake and/or exhaust valves, in relation to the timing and movement of the piston, is crucial to optimizing the operation of the two-stroke engine.

The present inventor is not the first to address the need for a simple, reliable means to control the timing and stroke of a valve of an internal combustion engine. An example of an apparatus designed for this purpose is found in U.S. Pat. Nos. 5,083,533 and 5,189,996 to Richeson et al. These two patents disclose a two-stroke internal combustion engine that operates with an exhaust valve that is controlled independently of crankshaft position in combination with a scavenging pump and fuel injector. The intention is to optimize power while reducing pollutant output. The volume of combustible mixture is established at the point in the cycle when the exhaust valve is selectably closed with the piston traveling upwardly and decreasing the volume of the cylinder. Throttling losses are eliminated since the piston forces the scavenging air out of the cylinder through the wide-open exhaust valve rather than the air being drawn into the cylinder against the reduced pressure caused by a partially closed throttle plate. The volume of combustible air in the cylinder is determined by the point in the cycle at which the exhaust valve is closed and a correspondingly appropriate charge of fuel is thereafter injected into the cylinder.

Unfortunately, and to the best of the knowledge of the present inventor, none of the foregoing nor any other prior art devices provide control over the timing and stroke of the intake valve of an internal combustion engine. Therefore, there remains a need for a means of controlling the timing and stroke of the intake valve of an internal combustion engine in order to optimize its operation. This is possible by providing a means for controlling the amount of pre-load force on the valve.

U.S. Pat. No. 5,558,054 to Ariga et al. discloses a means for controllably varying the pre-load force imposed on a valve spring in correlation with engine speed. At low engine speeds the pre-load force is maintained at a minimal level whereby the normal load at the cam/follower interface is maintained at a minimal value. At higher engine speeds, the pre-load force on the valve spring is selectively increased to assure positive closure of the valve head. The increased pre-load forces are imposed by extending a hydraulically actuated, moveable spring seating surface whereby the installed length of the spring is shortened. Unfortunately, the Ariga et al. device requires a continuously-flowing pneumatic system and this is unduly complicated and expensive.

It would be greatly advantageous to provide an improved means for controlling the timing and stroke of the intake valve of an internal combustion engine by controlling its pre-load, thereby increasing fuel economy while reducing emission of pollutants. An apparatus of this type should be simple, employing a minimal number of fabricated parts all of commercially available materials, such that the device is economical to manufacture and sell to provide for widespread use.

SUMMARY OF THE INVENTION

It is, therefore, the primary object of the present invention to provide an improved means for controlling the timing and stroke of the intake valve of an internal combustion engine to increase its fuel economy while reducing its emission of pollutants.

It is another object of the present invention to provide an improved means for controlling the timing and stroke of the intake valve of an internal combustion engine that incorporates variable spring force.

Another object of the present invention is to provide an improved means for controlling the timing and stroke of the intake valve of an internal combustion engine that is easy to adjust.

It is still another object of the present invention to provide an improved means for controlling the timing and stroke of the intake valve of an internal combustion engine that is simple and straightforward in design.

Yet another object of the present invention is to provide an improved means for controlling the timing and stroke of the intake valve of an internal combustion engine that is fabricated of strong, durable, resilient materials appropriate to the nature of their usage.

Still another object of the present invention is to provide an improved means for controlling the timing and stroke of the intake valve of an internal combustion engine that is economical to manufacture and sell.

These and other objects are accomplished by a variable spring force intake valve assembly for use in two- and four-stroke internal combustion engines. The present invention generally comprises an intake valve and a torsion spring attached to a gear and rod assembly. Manipulation, via manual or automated means, of the gear and rod assembly adjusts the tension/torsion force exerted by the torsion spring to hold the intake valve in the closed position.

Rotation of the gear and rod assembly in one direction increases the amount tension/torsion force exerted by the spring on the intake valve while rotation in the opposite direction reduces that force. Varying the tension/torsion force results in an ability to control the timing and the degree to which the ports of the intake valve are actually opened during the operating cycle of the piston, thereby providing a user with an opportunity to enhance the operation of a two- or four-stroke engine. The present invention's design is simple and straightforward, ay be fabricated of strong, durable, resilient materials appropriate to the nature of their usage, and may be economically manufactured and sold.

Alternative springs may be used, and alternative means for controlling the spring force acting on an intake valve include mechanically altering either the position of the base of a conventional, compression-style spring, or the position of the support for the upper end of a conventional tension spring.

BRIEF DESCRIPTION OF THE DRAWINGS

Other objects, features, and advantages of the present invention will become more apparent from the following detailed description of the preferred embodiments and certain modifications thereof when taken together with the accompanying drawings in which.

DETAILED DESCRIPTION OF THE PREFERRED EMBODIMENT

Figure 1:
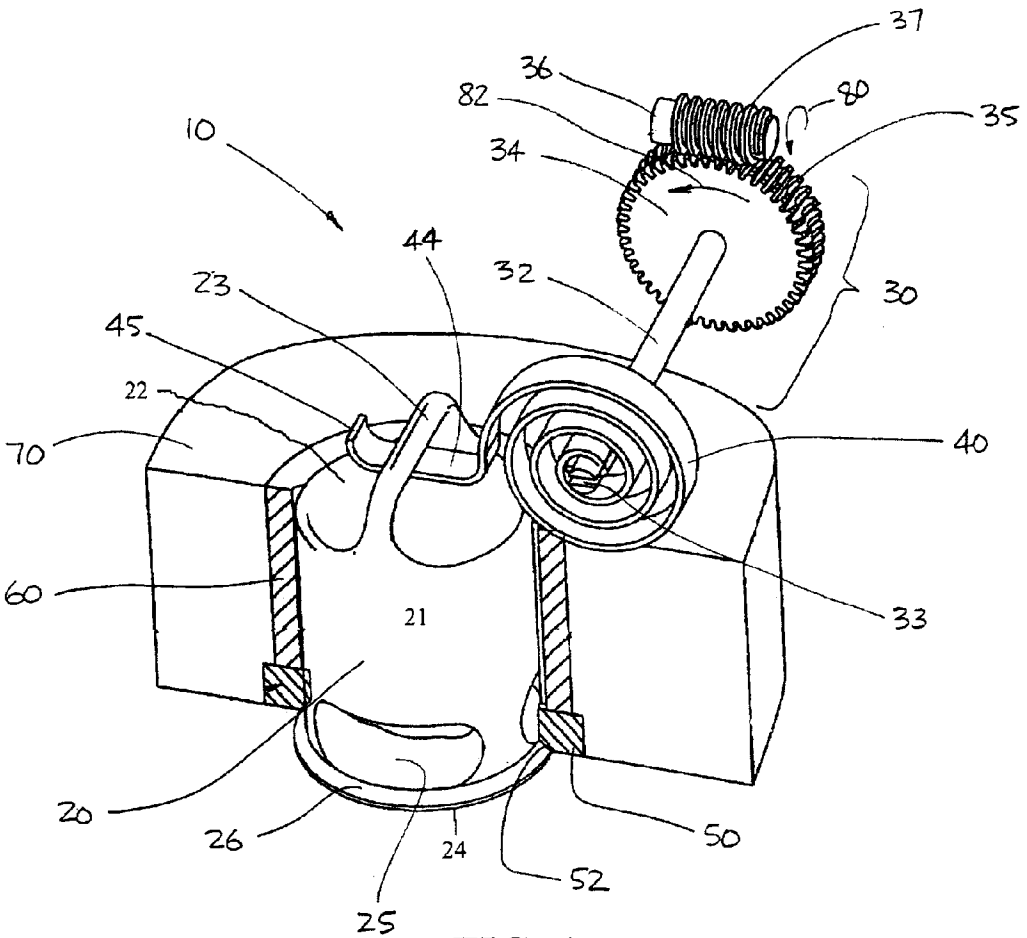
FIG. 1 is an oblique perspective view of a variable spring force intake valve assembly 10, according to a first embodiment of the present invention, shown with the intake valve 20 in the closed position.
Figure 2:
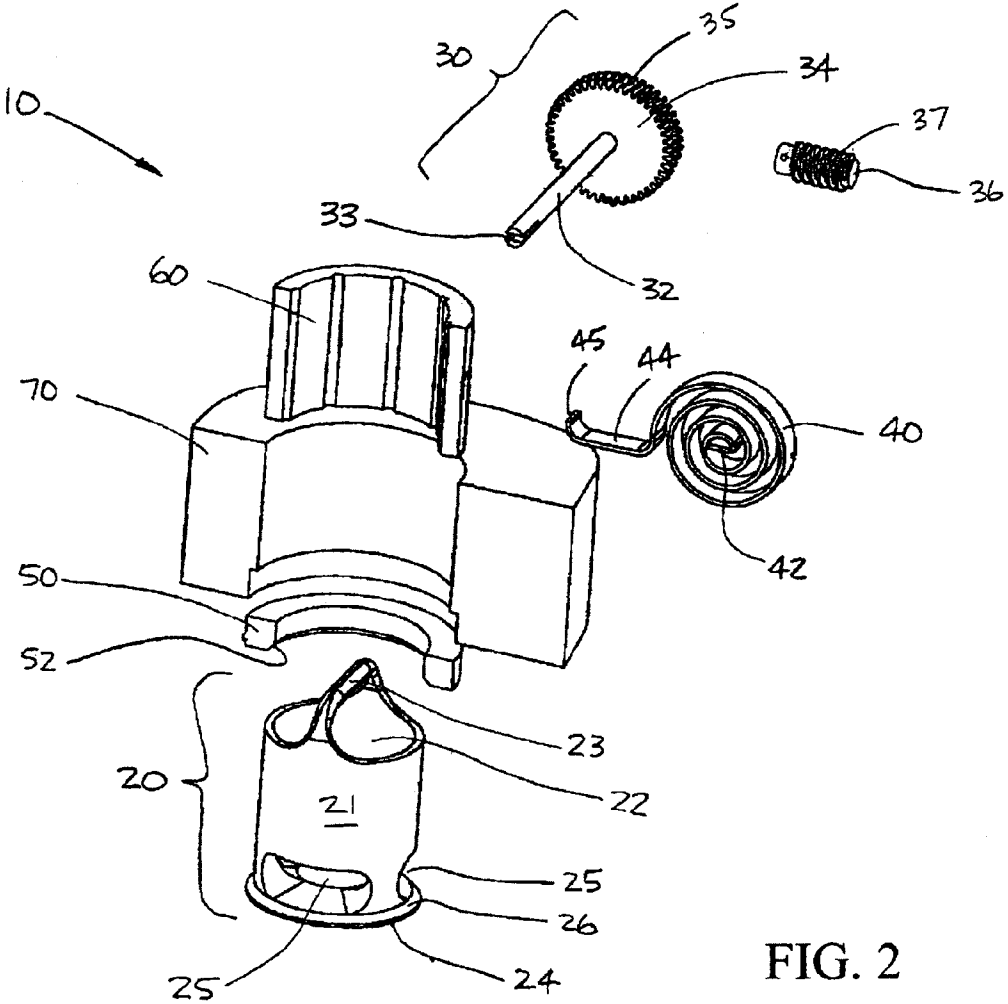
FIG. 2 is an exploded view of the variable spring force intake valve assembly 10 of FIG. 1.

FIGS. 1 and 2 are, respectively, oblique perspective and exploded views of a variable spring force intake valve assembly 10 according to a first embodiment of the present invention. The variable spring force intake valve assembly 10 generally comprises an intake valve 20 and a commercially available torsion spring 40, preferably helical, attached to an actuator which includes a gear and rod assembly 30 rotatably controlled either by manual or automated means (not shown in the Figures).

The intake valve 20 possesses a hollow, cylindrical body 21 with one substantially open end 22 formed with a spring-coupling post 23, and one substantially closed end having an end plate 24 and a plurality of ports 25 formed in the circumference of the cylindrical body 21 adjacent to the end plate 24. The end plate 24 is formed with an angled surface 26 that seals, when the intake valve 20 is in the closed position of FIG. 1, against a matching angled surface 52 formed in a valve seal 50 that is seated within a cylinder head 70. The cylindrical body 21 reciprocates, between an open position (not shown in the Figures) and the closed position of FIG. 1, within a valve guide/bushing 60 that is seated within the cylinder head 70 just above the valve seal 50. The intake valve 20, valve seal 50, valve guide/bushing 60, and cylinder head 70 are preferably fabricated of commercially available metals (e.g. carbon steel) possessing properties (e.g. strength, resistance to wear, chemical resistance) appropriate to the nature of their usage.

The intake valve 20 is selectively tensioned and untensioned by spring 40 (described below) which is selectively biased by an actuator that, in the illustrated embodiment, comprises a gear and rod assembly 30. The gear and rod assembly 30 further comprises a solid, cylindrical rod 32 fixedly attached at one end to a commercially available spur gear 34. The opposite end of the rod 32 is formed with a groove 33 that connects to the torsion spring 40 (see discussion below). The rod 32 is preferably fabricated of a commercially available metal (e.g. carbon steel) possessing properties (e.g. strength, chemical resistance) appropriate to the nature of its usage. A commercially available worm gear 36, rotatably controlled either by manual or automated means (not shown in the Figures), possesses helical teeth 37 that interlock with the teeth 35 of the spur gear 34. Worm gear 36 may be manually rotated by a simple knob, or by automated means such as a servo-motor (not shown in the Figures)

Torsion spring 40 is preferably a commercially available coil spring preferably comprises a section of metallic material formed into a helical configuration with a short, substantially straight inner end 42 and a long, substantially straight outer end 44 possessing a short, angled tip 45. The amount of torsional spring force available and the degree to which it may be varied are defined by the metallic material of construction combined with the finished spiral configuration (e.g. the number of complete 360° loops contained in the spring 40, the thickness of the material of construction). These characteristics of the torsion spring 40 may be changed to suit a variety of two- and four-stroke internal combustion engine applications, and it is contemplated that other spring-forms may be employed with other shapes and sizes.

The variable spring force intake valve assembly 10 is assembled as follows:

The valve seal 50 and the valve guide/bushing 60 are fixedly seated within the cylinder head 70. The intake valve 20 is slidably engaged with the inside surfaces of the valve seal 50 and the valve guide/bushing 60. In the closed position of FIG. 1, the angled surface 26 of the intake valve 20 rests against the matching angled surface 52 of the valve seal 50. The intake valve's sliding engagement with the inside surfaces of the seal 50 and the guide/bushing 60 is maintained by positioning the outer end 44 of the torsion spring 40 under the spring-coupling post 23. The angled tip 45 of the spring's outer end 44 serves to maintain the engagement between the end 44 and the spring-coupling post 23 when the intake valve 20 is opened (by the action of the piston during the operation of the engine). The inner end 42 of the torsion spring 40 engages the groove 33 located in one end of the rod 32 which, at its opposite end is fixedly attached to the spur gear 34. Finally, the spur gear 34 and the worm gear 36 are positioned such that their teeth 35, 37, respectively, form an appropriate motion transmission assembly.

The timing and degree to which the ports 25 of the intake valve 20 are actually opened during the operating cycle of the engine are adjusted by manually or automatically (e.g. a servomotor) rotating the worm gear 36. Rotation of the worm gear 36 in the direction of arrow 80 results in the rotation of the gear and rod assembly 30 in the direction of arrow 82. Rotation of the rod 32, and the groove 33 in its one end, in the direction of arrow 82 results in a reduction of the tension/torsion force present in the spring 40 (i.e. the spiral configuration is "loosened") and a coincident reduction in the force required to open the intake valve 20. Conversely, rotation of the worm gear 36 in the direction opposite to arrow 80 results in the rotation of the gear and rod assembly 30 in the direction opposite to arrow 82. Rotation of the rod 32, and the groove 33 in its one end, in the direction opposite to arrow 82 results in an increase in the tension/torsion force present in the spring 40 (i.e. the spiral configuration is "tightened") and a coincident increase in the force required to open the intake valve 20.

Once again with respect to FIGS. 1 and 2, manipulation, via manual or automated means, of the gear and rod assembly 30 adjusts the tension/torsion force exerted by the torsion spring to selectively hold the intake valve in the closed position. Varying the tension/torsion force results in an ability to control the timing and the degree to which the ports of the intake valve are actually opened during the operating cycle of the piston, thereby providing a user with an opportunity to enhance the operation of a two- or four-stroke internal combustion engine. As is readily perceived in the foregoing description, the design of the variable spring force intake valve 10 is simple and straightforward, fabricated of strong, durable, resilient materials appropriate to the nature of their usage, and may be economically manufactured and sold implementation of the present invention will increase the fuel economy while reducing the emission of pollutants associated with the operation of two- and four-stroke internal combustion engines.

Having now fully set forth the preferred embodiment and certain modifications of the concept underlying the present invention, various other embodiments as well as certain variations and modifications of the embodiments herein shown and described will obviously occur to those skilled in the art upon becoming familiar with said underlying concept. It is to be understood, therefore, that the invention may be practiced otherwise than as specifically set forth in the appended claims.

We claim:

1. A variable spring force air intake valve assembly for an internal combustion engine, comprising:

a valve guide;

an air intake valve seated within said valve guide for reciprocating motion, said air intake valve being formed with a spring coupling post;

a helical coil spring attached at an outer end to the spring coupling post for imparting a pre-load on said air intake valve;

a rod attached to an inner end of said helical coil spring; and means attached to another end of said rod for selectively coiling and uncoiling said spring to thereby vary the pre-load on said air intake valve.

2. The variable spring force intake valve assembly for an internal combustion engine according to claim 1, wherein said helical coil spring is a helical torsion spring.

3. The variable spring force intake valve assembly for an internal combustion engine according to claim 1, wherein imparting said pre-load on said intake valve controls intake valve timing and stroke on said internal combustion engine.

4. A variable spring force intake valve assembly for an internal combustion engine, comprising:

a valve guide;

an air intake valve seated within said valve guide for reciprocating motion;

a helical coil spring attached at an outer end to the air intake valve for imparting a pre-load on said air intake valve;

a rod attached at one end to an inner end of said helical coil spring; and an actuator attached to another end of said rod for controllably varying the position of the rod to vary a base force of the coil spring and thereby vary a pre-load on said air intake valve in accordance with a desired performance from the engine.

5. The variable spring force intake valve assembly for an internal combustion engine according to claim 4, wherein said air intake valve is formed with a spring coupling post, and said helical coil spring is attached at said outer end to the spring coupling post for imparting said pre-load on said air intake valve.

6. The variable spring force intake valve assembly for an internal combustion engine according to claim 5, wherein said helical coil spring is a helical torsion spring.

7. The variable spring force intake valve assembly for an internal combustion engine according to claim 4, wherein said actuator further comprises a gear and rod assembly for selectively tensioning and untensioning said spring to thereby vary a pre-load on said intake valve.

8. The variable spring force intake valve assembly for an internal combustion engine according to claim 7, wherein said gear assembly further comprises a spur gear, said rod being fixedly attached at one end to said spur gear, another end of said rod being formed with a groove that connects to the inner end of the helical torsion spring.

9. The variable spring force intake valve assembly for an internal combustion engine according to claim 8, wherein said gear assembly further comprises a worm gear in operative engagement with said spur gear.

10. The variable spring force intake valve assembly for an internal combustion engine according to claim 4, wherein varying said pre-load on said intake valve controls intake valve timing and stroke on said internal combustion engine.

* * * * *